US010174582B2

(12) United States Patent
Windegaard et al.

(10) Patent No.: US 10,174,582 B2
(45) Date of Patent: Jan. 8, 2019

(54) WELLBORE ANNULAR SAFETY VALVE AND METHOD

(71) Applicant: Schlumberger Technology Corporation, Sugar Land, TX (US)

(72) Inventors: Eirik Windegaard, Stavanger (NO); Bjoern Staale Varnes, Stavanger (NO); Niek Dijkstra, Houston, TX (US); Geir Meling, Stavanger (NO); Graham Watson, Aberdeen (GB); Emmanuel Balster, Stavanger (NO); Magnus Paulsen, Stavanger (NO); Jone Sigmundsen, Stavanger (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 154 days.

(21) Appl. No.: 14/760,673

(22) PCT Filed: Jan. 10, 2014

(86) PCT No.: PCT/US2014/011060

§ 371 (c)(1),
(2) Date: Jul. 13, 2015

(87) PCT Pub. No.: WO2014/110382

PCT Pub. Date: Jul. 17, 2014

(65) Prior Publication Data

US 2015/0354315 A1 Dec. 10, 2015

Related U.S. Application Data

(60) Provisional application No. 61/751,636, filed on Jan. 11, 2013.

(51) Int. Cl.

| | |
|---|---|
| ***E21B 33/129*** | (2006.01) |
| ***E21B 43/12*** | (2006.01) |
| ***E21B 34/08*** | (2006.01) |
| ***E21B 33/126*** | (2006.01) |
| ***E21B 33/12*** | (2006.01) |
| ***E21B 34/10*** | (2006.01) |

(52) U.S. Cl.

CPC ..... *E21B 33/1294* (2013.01); *E21B 33/126* (2013.01); *E21B 33/1208* (2013.01); *E21B 33/1293* (2013.01); *E21B 34/101* (2013.01); *E21B 43/123* (2013.01)

(58) Field of Classification Search

CPC .... E21B 33/1294; E21B 34/08; E21B 43/123; E21B 34/101

See application file for complete search history.

(56) References Cited

U.S. PATENT DOCUMENTS 3,118,502 A * 1/1964 Cochran ..... E21B 33/1294 166/129
7,360,602 B2 4/2008 Kritzler et al.
7,762,322 B2 * 7/2010 Andersen ..... E21B 17/023 166/118

(Continued)

*Primary Examiner* — Cathleen R Hutchins

(57) ABSTRACT

A well system includes an annular barrier separating the tubing-casing annulus into an upper annulus and a lower annulus and a barrier valve coupled with the annular barrier, the barrier valve permitting one-way fluid communication from the upper annulus to the lower annulus.

16 Claims, 5 Drawing Sheets

(56) References Cited

U.S. PATENT DOCUMENTS

| | | | | |
|---|---|---|---|---|
| 2009/0095467 | A1* | 4/2009 | Phoi-montri | E21B 43/122<br>166/142 |
| 2011/0101613 | A1* | 5/2011 | McRobb | E21B 33/1216<br>277/312 |
| 2011/0132593 | A1* | 6/2011 | Phloi-montri | E21B 43/122<br>166/54.1 |
| 2011/0315401 | A1 | 12/2011 | White et al. | |

* cited by examiner

WELLBORE ANNULAR SAFETY VALVE AND METHOD

BACKGROUND

This section provides background information to facilitate a better understanding of the various aspects of the disclosure. It should be understood that the statements in this section of this document are to be read in this light, and not as admissions of prior art.

Hydrocarbon fluids such as oil and natural gas are obtained from a subterranean geological formation, referred to as a reservoir, by drilling a well that penetrates the hydrocarbon-bearing formation. Forms of well completion components may be installed in the wellbore to control and enhance efficiency of producing fluids from the reservoir.

SUMMARY

A well system in accordance to one or more embodiments includes an annular barrier disposed in a tubing-casing annulus of a wellbore separating the tubing-casing annulus into an upper annulus and a lower annulus and a barrier valve coupled with the annular barrier, the barrier valve permitting one-way fluid communication from the upper annulus to the lower annulus. An annular safety valve in accordance with an embodiment includes top and bottom seal elements disposed about a mandrel having a tubing bore, a fluid conduit extending through the mandrel and substantially parallel to the tubing bore, and a barrier valve in connection with the fluid conduit to permit one-way fluid flow through the fluid conduit. A method includes deploying tubing having a tubing bore in casing in a wellbore, the tubing having a packer forming an annular barrier across a tubing-casing annulus, the packer having a fluid conduit extending substantially parallel to the tubing bore, and a barrier valve coupled with the fluid conduit to permit one-way fluid flow from the upper annulus to the lower annulus, communicating a fluid from the upper annulus through the barrier valve to the lower annulus, and closing the barrier valve in response to pressure in the upper annulus being less than pressure in the lower annulus.

The foregoing has outlined some of the features and technical advantages in order that the detailed description of the annular safety valves, systems, and methods that follow may be better understood. Additional features and advantages of the annular safety valve system and method will be described hereinafter which form the subject of the claims of the invention. This summary is not intended to identify key or essential features of the claimed subject matter, nor is it intended to be used as an aid in limiting the scope of claimed subject matter.

BRIEF DESCRIPTION OF THE DRAWINGS

Embodiments of annular safety valves and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
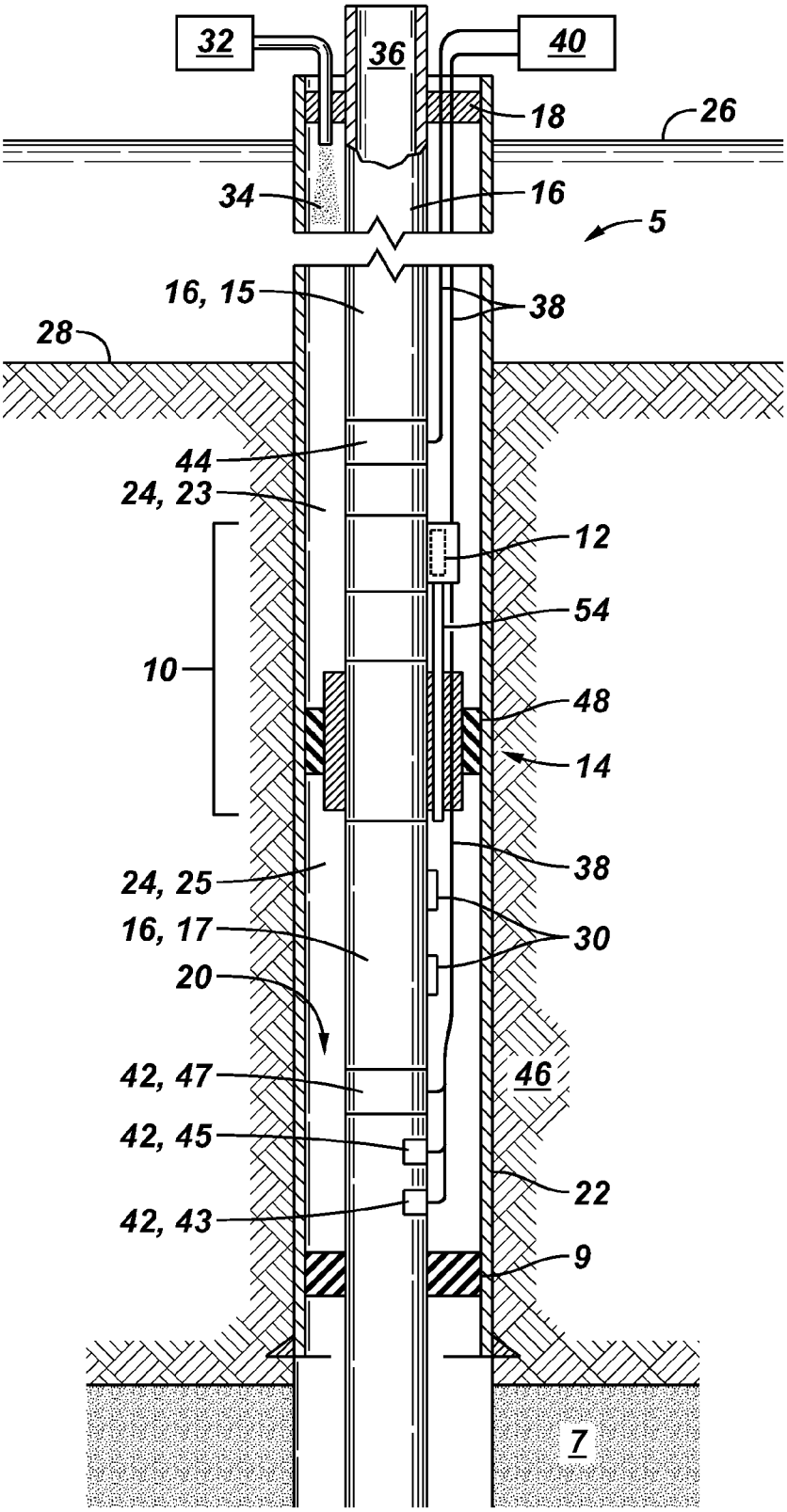
FIG. 1 illustrates a well system in which an annular safety valve in accordance to one or more embodiments is incorporated.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "top" and "bottom," and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

Generally, a well consists of a wellbore drilled through one or more reservoir production zones. Conductor casing serves as support during drilling operations and provides support for a wellhead and Christmas tree. In offshore wells, a riser may extend the wellbore from the sea floor to the surface platform. One or more strings of casing with diminishing inside diameters will be run inside of the conductor. The well may then be completed with a tubing string extending to the one or more reservoir production zones. The annulus between the tubing and the smallest diameter casing, i.e., the A-annulus, extends from the producing zones to the surface. The surface barrier seals the tubing-casing annulus from the environment. The tubing may be landed for example in a production packer located above the upper most production zone to isolate the annulus from the producing zones. The tubing-casing annulus may extend thousands of feet from the surface to the production packer. The tubing-casing annulus may be utilized for example for gas-injection into the tubing to reduce the density of the fluid in the tubing to facilitate production to the surface. The tubing-casing annulus may be exposed to the surrounding formations via perforations or the loss of casing integrity. In the case of failure of the surface annular barrier, for example located at the wellhead, wellbore fluid in the tubing-casing annulus will be in communication with the environment.

In accordance to one or more embodiments, an annular safety valve is integrated in the tubing to provide an annular safety barrier in the upper completion. In accordance with embodiments, the annular safety valve provides one-way fluid flow from the upper annulus to the lower annulus. In accordance to one or more embodiments, the annular safety valve provides one or more control line bypasses to operationally connect devices in the lower completion below the annular safety valve to surface control systems at the surface or in the upper completion above the annular safety valve. In accordance to one or more embodiments, the annular safety valve is not surface controlled.

FIG. 1 illustrates a well system 5 in which a subsurface annular safety valve ("ASV"), generally denoted by the numeral 10, may be incorporated and utilized. Annular safety valve 10 includes a one-way barrier valve 12 coupled with an annular barrier 14. In accordance with embodiments, annular barrier 14 is packer, for example a dual cup packer, a swell packer, inflatable packer, or a slip type packer. Annular barrier 14 includes at least one sealing element 48 to provide a sealed annular barrier between the tubing and casing. Barrier valve 12 is illustrated as being located above annular barrier 14 in FIG. 1; however, as will be understood by those skilled in the art with benefit of this disclosure, barrier valve 12 may be located below annular barrier 14. Barrier valve 12 provides one-way fluid flow in the direction from the upper completion or upper annulus across annular barrier 14 to the lower completion or lower annulus. In accordance to one or more embodiments, barrier valve 12 is normally closed, fail safe close, and actuated to the open position in response to pressure in the upper annulus being greater than pressure in the lower annulus. Similarly, barrier valve 12 is actuated to the closed position in response to pressure in the lower annulus exceeding pressure in the upper annulus.

Well system 5 is illustrated as a gas lift completion that includes tubing 16 that extends from an upper or surface barrier 18 into a wellbore 20. A portion of wellbore 20 is completed with casing 22. The tubing-casing annulus, generally denoted by the numeral 24, between tubing 16 and casing 22 may be referred to as the A-annulus. Surface barrier 18, for example a tubing hanger, is depicted in FIG. 1 located at a water surface 26, for example at a platform, e.g., tension leg platform, or ship, positioned above a sea floor 28. Surface barrier 18 may be located in the wellhead area. Reference to the surface of the well is not limited to the sea surface or sea floor. Annular safety valve 10 is set in the upper completion and separates tubing-casing annulus 24 into an upper annulus 23 and a lower annulus 25. Tubing 16 may be landed at a production packer 9 isolating lower annulus 25 from a production zone 7, i.e., reservoir formation. Production packer 9 may be utilized to anchor tubing 16 and annular safety valve 10 with casing 22.

Tubing 16 incorporates one or more gas lift valves 30 which are located in the lower tubing section 17 below annular safety valve 10 in wellbore 20. For purposes of gas injection, well system 5 includes a gas compressor 32 located at the surface to pressurize gas that is communicated to tubing-casing annulus 24. The pressurized gas 34 is communicated from upper annulus 23 through annular safety valve 10 to lower annulus 25. The pressurized gas 34 is communicated from lower annulus 25 into tubing bore 36 through gas lift valves 30.

One or more control lines 38 may extend from a surface system 40, for example an electronic controller and or pressurized fluid source, to downhole devices, generally denoted by the numeral 42, located below annular safety valve 10. Downhole devices 42 may include devices such as, and without limitation to, pressure, temperature, and flow rate sensors 43, chemical injection valves 45, and flow control valves 47. In accordance to one or more embodiments, annular safety valve 10 provides control line bypasses from the upper completion or surface to the lower completion while maintaining an annular barrier.

Together, annular safety valve 10 and tubing 16 can serve as a primary barrier to maintain well integrity. In the depicted embodiment, a downhole safety valve 44 is located in the upper section 15 of tubing 16, for example proximate to annular barrier 14, to provide a vertical barrier through tubing bore 36. In this example, downhole safety valve 44 is a surface controlled subsurface safety valve ("SCSSV") connected to the surface via a control line 38. Subsurface safety valve 44 may be a wireline or tubing set type. Annular safety valve 10 serves as a safety barrier in A-annulus 24 in the event that surface barrier 18 is lost. Lower annulus 25 although located above production packer 9 in FIG. 1, may be in communication with formation fluids and pressure. For example, perforations or the loss of integrity of casing 22 may expose tubing-casing annulus 24 to the surrounding formation 46. In some instances gas lift injection through lower annulus 25 may temporarily supercharge formation 46.

Figure 2:
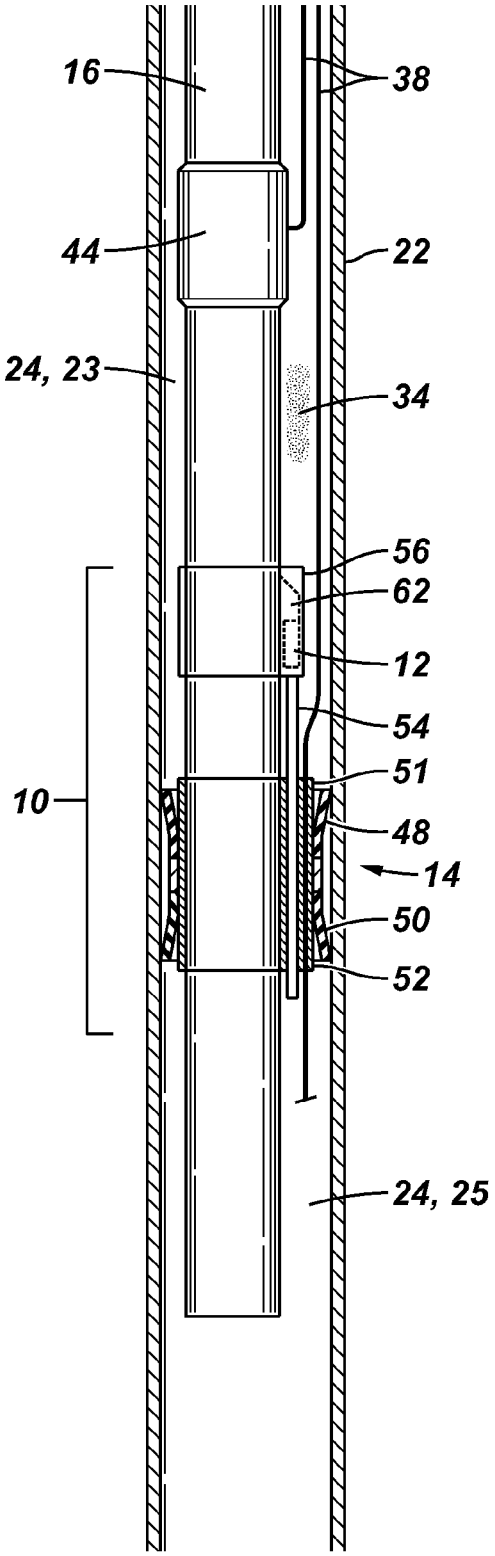
FIG. 2 illustrates an annular safety valve in accordance to one or more embodiments incorporating a cup type packer.
Figure 3:
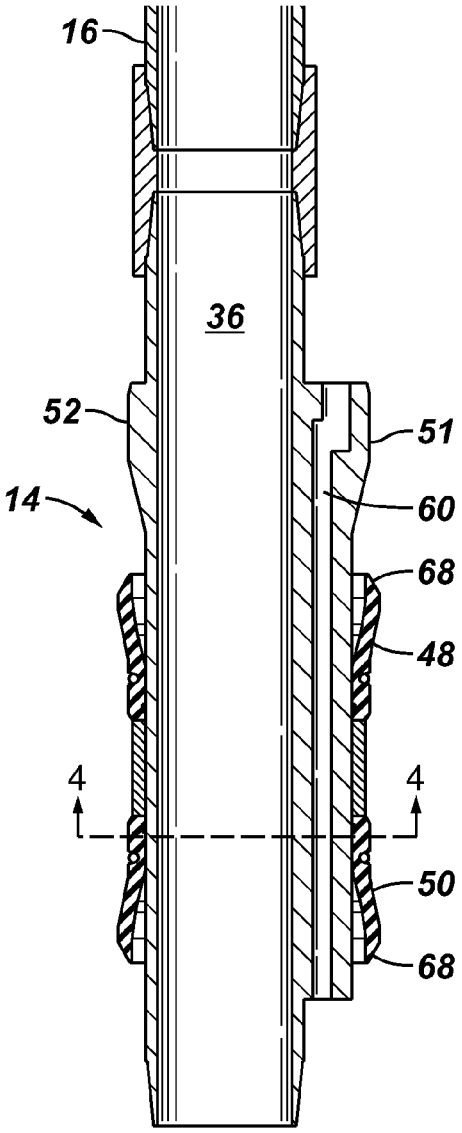
FIG. 3 illustrates an annular barrier in accordance to one or more embodiments.
Figure 4:
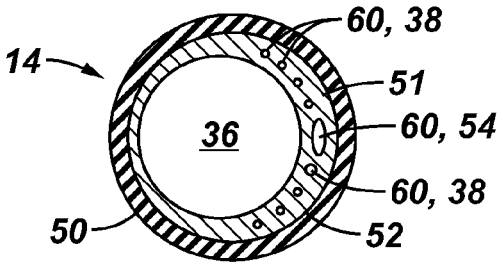
FIG. 4 illustrates an annular barrier along the line 4-4 of FIG. 3 in accordance to one or more embodiments.

FIG. 2 illustrates a retrievable annular safety valve 10 integrated in tubing 16 and deployed in casing 22. FIG. 3 illustrates annular barrier 14 in isolation and FIG. 4 illustrates a sectional view of an annular barrier 14 from the bottom. Annular barrier 14 is illustrated in FIGS. 2-4 as a dual cup packer having a top cup packer 48, i.e. seal element, or downstream cup packer and a bottom cup packer 50, i.e. seal element, or upstream cup packer. Top cup packer 48 has an open end 68 oriented toward upper annulus 23 and bottom cup packer 50 has an open end 68 oriented toward lower annulus 25. Pressure in upper annulus 23 expands top cup packer 48 against casing 22 and pressure in lower annulus 25 expands bottom cup packer 50 against casing 22.

Seal elements 48, 50 are disposed circumferentially about a feed-through mandrel 52 having a thick side 51. Bypass ports, generally denoted by the reference number 60, are formed longitudinally through thick side 51 of annular barrier 14, for example substantially parallel to tubing bore 36, to pass or form a portion of an annular fluid conduit 54 (e.g., gas transport tube or conduit). Barrier valve 12 is coupled with fluid conduit 54 to provide one-way fluid flow from upper annulus 23 to lower annulus 25. In FIG. 2, barrier valve 12 is located in a side pocket mandrel 56 integrated, i.e., connected, with tubing 16. Annular safety valve 10 is illustrated in FIG. 2 eccentrically disposed in casing 22 with side pocket 62 aligned longitudinally with thick side 51 of annular barrier 14. Barrier valve 12 may be located below annular barrier 14, for example with the fluid conduit 54 extending through annular barrier 14 and down to barrier valve 12 whereby one-way fluid flow is provided from the upper annulus through the annular barrier 14 and the barrier valve 12 into the lower annulus.

One or more additional bypass ports 60 are formed through annular barrier 14, for example feed-through mandrel 52, to pass control lines 38. The annular barrier 14 depicted in FIG. 4 forms eight bypasses 60 communicating control lines 38. Control lines 38 include without limitation, electrical, optic, chemical, and hydraulic lines.

Figure 5:
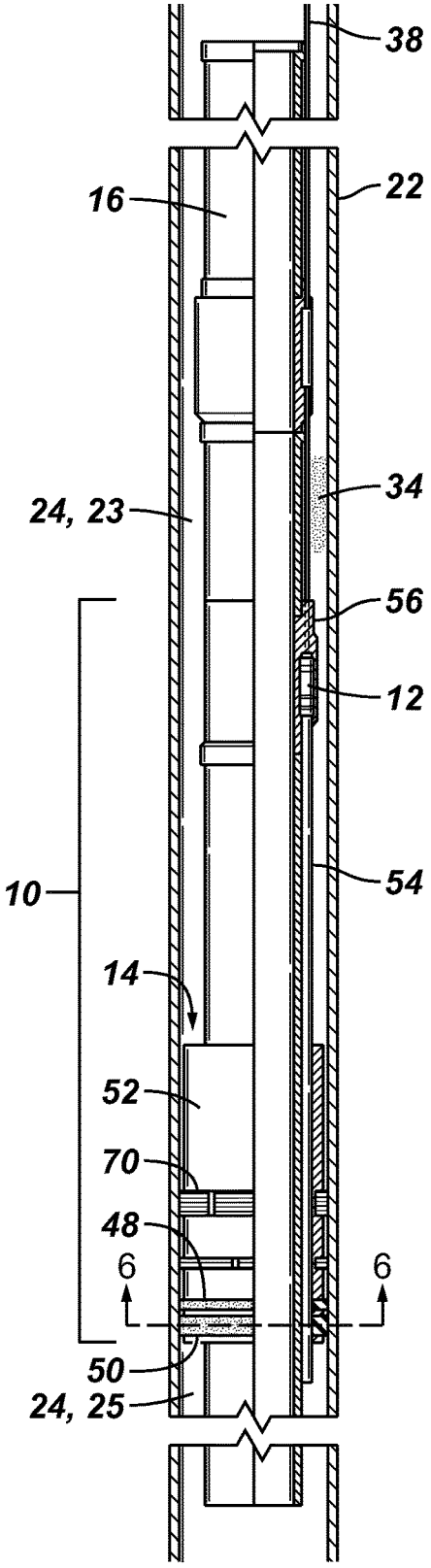
FIG. 5 illustrates an annular safety valve in accordance to one or more embodiments incorporating slip type packer.
Figure 6:
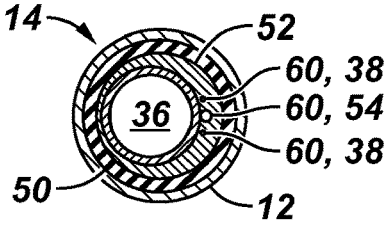
FIG. 6 illustrates an annular barrier along the line 6-6 of FIG. 5 in accordance to one or more embodiments.

FIG. 5 illustrates a retrievable annular safety valve 10 integrated in tubing and deployed in casing 22. In FIG. 5, annular barrier 14 is illustrated as a slip-type of packer. FIG. 6 is a sectional illustration of the annular barrier of FIG. 5. In the depicted embodiment annular barrier 14 includes a top seal element 48 and a bottom seal element 50 and slips 70 (e.g., dogs, grippers). Setting of the annular barrier 14 (i.e. packer) causes the packer to expand the seal elements to form an annular seal. In the illustrated example, the annular barrier 14 is a dual packer having a top seal element 48 and a bottom seal element 50. Also, when the packer is set the slips 70 radially expand and engaged the well of casing 22 to anchor the packer to the casing.

The annular barrier 14 illustrated in FIGS. 5 and 6 is a hydraulically set, retrievable dual bore (e.g. bore 36 and fluid conduit 54) packer that may be run as an integral part of the completion string (e.g., tubing 16). In accordance to some embodiments, the packer is hydraulically set and may be released by cutting the primary mandrel. For example, to set the packer, hydraulic pressure is applied through a control line into a piston chamber, which compresses the seal elements and slips against the casing creating a seal and locking the tubing and packer to the casing. A lock prevents the setting force from releasing after the setting pressure is bled off. During setting there is no movement of the pacer relative to the casing string. To release the packer a dedicated cutting tool deployed on wireline cuts the packer mandrel below a retainer. The lower tubing pulls a guide downward and the retainer releases the compression on the seal elements and slips. Picking up tubing weight, the slips fully retract and the packer may be pulled from the well.

In accordance to an embodiment, the mandrel 52 is machined from a single steel bar. There is no potential leak path from the tubing bore 36 to the annulus 24 via the mandrel below the seal elements. Mandrel 52 may be drilled to accept bypasses 60 for control lines 38 and/or fluid conduit 54. In accordance, to embodiments fluid conduit 54 and bore 36 are the dual bores of the packer. In accordance to an embodiment slips 70 are designed to maintain maximum force in either direction. A dual cone may ensure contact along the whole slips length. In accordance to an embodiment the slips are Nitrile hardened. In an embodiment, slips 70 are about ten inches long and have 360 degree contact with the casing to minimize damage to the casing while the forces are at maximum during well operations.

The seal elements (packing elements) may be constructed for example of hydrogenated nitrile butadiene rubber (HNBR) and have metal sheets on the top and bottom of the elements to protect from being washed out while running in-hole or during circulation.

Figure 7:
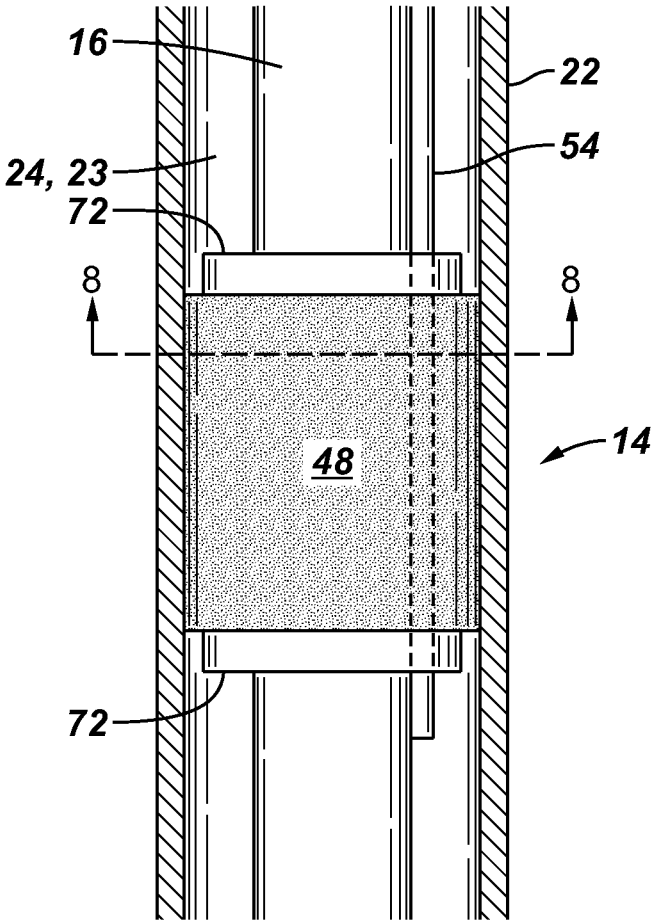
FIG. 7 illustrates an annular barrier of an annular safety valve provided by a swell packer in accordance to one or more embodiments.
Figure 8:
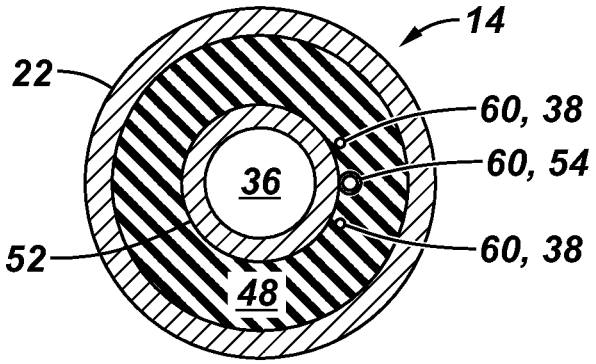
FIG. 8 is a section illustration of the annular barrier illustrated in FIG. 7 in accordance to one or more embodiments.
Figure 9:
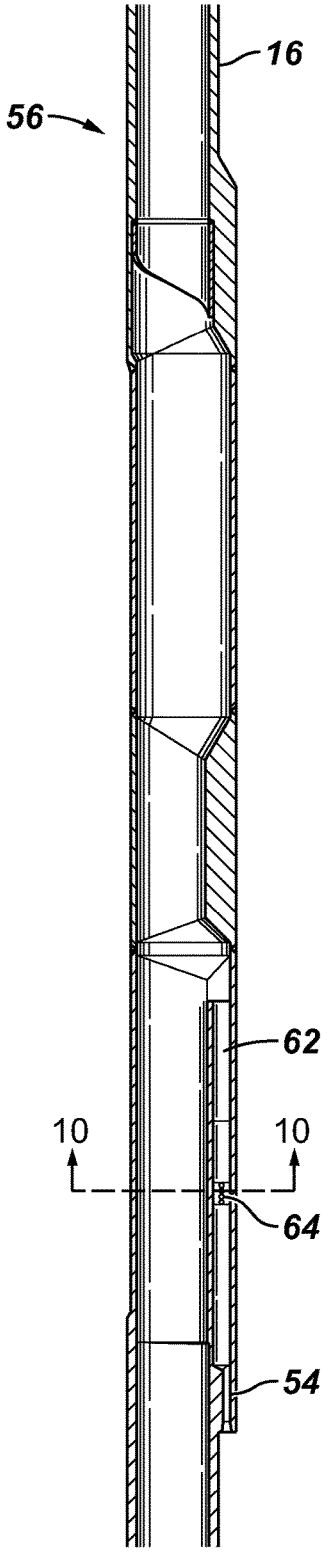
FIG. 9 illustrates a side pocket mandrel in accordance to one or more embodiments.
Figure 10:
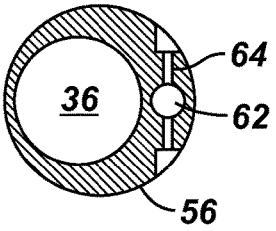
FIG. 10 illustrates a side pocket mandrel along the line 10-10 of FIG. 9.

FIGS. 7 and 8 are illustrations of an annular barrier 14 formed by a swell packer. Swell packer 14 includes a mandrel 52 and swellable seal element 48. In FIG. 7, swell packer 14 includes stops 72 located on opposing sides of swellable seal element 48 to limit the longitudinal expansion of the swellable seal element. Swellable seal element 48 is constructed of a material that increases in volume and expands radially outward in response to a particular fluid. For example, the sealing element material may swell in response to exposure to a hydrocarbon fluid or water. FIG. 8 is a section view of an expanded swell annular barrier 14. In the FIG. 8 example, control line bypasses 60, 38 and fluid conduit 54 may be located through mandrel 52 and/or swellable seal element 48.

With reference in particular to FIGS. 1-2, 5, and 9-11, barrier valve 12 is a one-way valve providing fluid connection across annular barrier 14 from upper annulus 23 to lower annulus 25 through passage or conduit 54. Barrier valve 12 is located in a side pocket mandrel 56. Barrier valve 12 is disposed in pocket 62 (FIGS. 2, 9, 10) to provide one-way annulus to annulus fluid communication. Fluid, such as gas 34, flows from upper annulus 23 through port(s) 64 (FIGS. 9, 10) into pocket 62 and through barrier valve 12 into conduit 54 and then into lower annulus 25. Side pocket mandrel 56 may not include a port between tubing-casing annulus 24 and tubing bore 36 or the tubing bore may not be in communication with tubing-casing annulus 24 through barrier valve 12. Side pocket mandrel 56 may be a single or a dual pocket mandrel.

Figure 11:
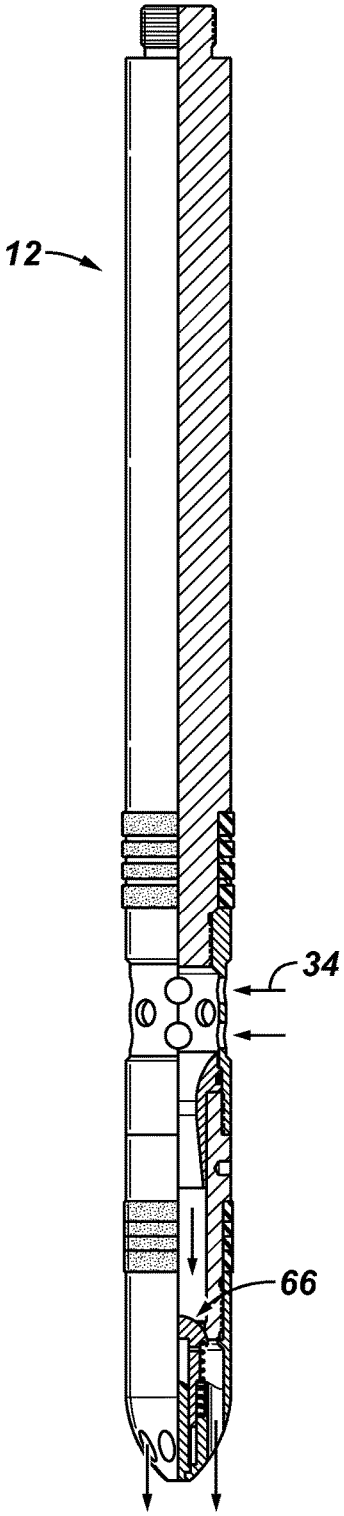
FIG. 11 illustrates a barrier valve in accordance to one or more embodiments.

FIG. 11 illustrates a gas lift type barrier valve 12 in accordance to one or more embodiments. Barrier valve 12 includes a reverse flow check valve 66 suited for barrier applications. For example, barrier valve 12 is a barrier-qualified, reverse flow check valve that provides positive seal between the lower annulus side and the upper annulus side. In accordance to one or more embodiments, barrier valve 12 has metal-to-meal seal surfaces without elastomers. Some embodiments may have elastomer seal surfaces. A non-limiting example of barrier valve 12 is a NOVA 15-B type of gas lift valve available from Schlumberger.

In accordance to one or more embodiments, a surface control system is not required for operation of annular safety valve 10. Barrier valve 12 may be retrieved, for example via wireline or slickline, eliminating the need to retrieve the completion, e.g., tubing, to maintain the well integrity. If the pressure in lower annulus 25 exceeds the pressure in upper annulus 23, barrier valve 12 closes. Accordingly, barrier valve 12 fails safe closed if the surface barrier is lost. Annular safety valve 10 is insensitive to setting depth. In accordance with one or more embodiments, barrier valve 12 may be eliminated for example by eliminating or plugging conduit 54. For example, a dummy valve may be landed in pocket 62 to plug conduit 54.

A method in accordance to one or more embodiments is now described with reference to FIGS. 1-11. When running the completion, tubing 16 is made-up at the surface to include annular safety valve 10 located above gas-lift valves 30. Side-pocket mandrel 56 and annular barrier 14 are aligned such that side pocket 62 and thick side 51 are aligned longitudinally. Fluid conduit 54 is connected with or passed through a bypass port 60 of annular barrier 14. Control lines 38 are connected with or passed through bypass ports 60. Annular safety valve 10 is run into the wellbore. Annular barrier 14 is set to such that a seal element 48 seals with casing 22 separating tubing-casing annulus 24 into an upper annulus 23 and a lower annulus 25. Fluid, for example gas 34, is communicated from upper annulus 23 through barrier valve 12 and across annular barrier 14 in response to pressure in the upper annulus being greater than pressure in lower annulus 25. Gas 34 is injected from lower annulus 25 through gas lift valves 30 into tubing bore 36. Barrier valve 12 closes in response to the pressure in upper annulus 23 being less than the pressure in lower annulus 25.

The foregoing outlines features of several embodiments of annular safety valves, systems, and methods so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A well system (5), comprising:

a wellbore (20) extending downward from a surface, the wellbore comprising a tubing (16) deployed in a casing (22);

an annular barrier (14) having seal elements (48, 50), the annular barrier (14) being disposed in a tubing-casing annulus (24) separating the tubing-casing annulus into an upper annulus (23) and a lower annulus (25);

a barrier valve (12) coupled with the annular barrier via a fluid conduit (54), the barrier valve (12) permitting one-way fluid communication from the upper annulus to the lower annulus wherein the barrier valve is located above the annular barrier and externally of the seal elements (48, 50); and a control line extending from above the annular barrier through the annular barrier to a device (42) located below the annular barrier.

2. The well system of claim 1, wherein the annular barrier is selected from one of a slip-type packer and a cup packer.

3. The well system of claim 1, wherein the annular barrier comprises a swell packer.

4. The well system of claim 1, wherein the barrier valve is disposed in a side pocket mandrel (56) integrated in the tubing.

5. The well system of claim 1, wherein the barrier valve is operated to an open position in response to pressure in the upper annulus being greater than pressure in the lower annulus.

6. The well system of claim 1, wherein the barrier valve is located in a side pocket mandrel integrated in the tubing; and the annular barrier comprises a radially expandable seal element (48) and radially expandable slips (70).

7. The well system of claim 6, further comprising gas lift valves (30) located in the tubing below the annular barrier.

8. An annular safety valve (10), comprising:

a top seal element (48) of an annular barrier (14) disposed about a mandrel (52) forming a tubing bore (36);

a bottom seal element (50) of the annular barrier (14) disposed about the mandrel;

a fluid conduit (54) extending through the mandrel substantially parallel to the tubing bore; and a barrier valve (12) in connection with the fluid conduit to permit one-way fluid flow through the fluid conduit wherein the barrier valve is located above the annular barrier externally of the top seal element (48) and the bottom seal element (50); and a control line extending from above the annular barrier through the annular barrier to a device (42) located below the annular barrier.

9. The annular safety valve of claim 8, wherein the barrier valve is disposed in a side pocket mandrel (56).

10. The annular safety valve of claim 8, wherein the mandrel comprises a port (60) to pass the control line (38) across the top and the bottom seal elements.

11. The annular safety valve of claim 8, wherein the barrier valve is normally closed.

12. A method, comprising:

deploying a tubing (16) having a tubing bore (36) in a casing (22) in a wellbore (20), the tubing comprising a packer having at least one sealing element (48 and/or 50) forming an annular barrier across a tubing-casing annulus (24) separating the tubing-casing annulus into an upper annulus (23) and a lower annulus (25), the packer having a fluid conduit (54) extending substantially parallel to the tubing bore and through the annular barrier;

positioning a barrier valve (12) externally of the at least one sealing element (48 and/or 50) of the annular barrier and coupling the barrier valve (12) with the fluid conduit to permit one-way fluid flow from the upper annulus to the lower annulus;

communicating a fluid from the upper annulus through the barrier valve to the lower annulus; and closing the barrier valve in response to pressure in the upper annulus being less than pressure in the lower annulus.

13. The method of claim 12, wherein the fluid is a pressurized gas and further comprising injecting the pressurized gas from the lower annulus through a gas lift valve (30) into the tubing bore.

14. The method of claim 12, wherein the barrier valve is located in a side pocket mandrel (56) integrated in the tubing.

15. The method of claim 12, wherein the barrier valve is normally closed and the barrier valve is opened in response to pressure in the upper annulus being greater than pressure in the lower annulus.

16. The method of claim 12, wherein:

the barrier valve is located in a side pocket mandrel (56) integrated in the tubing;

the fluid is a pressurized gas; and further comprising injecting the pressurized gas from the lower annulus through a gas lift valve (30) into the tubing bore.

* * * * *